US005297871A

United States Patent [19]

Fujioka

[11] Patent Number: 5,297,871

[45] Date of Patent: Mar. 29, 1994

[54] PAPER FEEDING CONTROL APPARATUS AND METHOD FOR PRINTERS

[75] Inventor: Satoshi Fujioka, Nagano, Japan

[73] Assignee: Seiko Epson Corporation, Tokyo, Japan

[21] Appl. No.: 800,106

[22] Filed: Nov. 29, 1991

[30] Foreign Application Priority Data

Nov. 30, 1990 [JP] Japan ..... 2-337279
Aug. 9, 1991 [JP] Japan ..... 3-225214

[51] Int. Cl.[5] ..... B41J 19/92

[52] U.S. Cl. ..... 400/568; 400/636; 400/707.1; 400/582

[58] Field of Search ..... 400/568, 706, 707, 707.1, 400/636, 638, 639, 582

[56] References Cited

U.S. PATENT DOCUMENTS

| | | | |
|---|---|---|---|
| 4,195,940 | 4/1980 | Rekewitz | 400/568 |
| 4,533,269 | 8/1985 | Pou et al. | 400/582 |
| 4,737,924 | 4/1988 | Miki | 364/519 |
| 4,780,012 | 10/1988 | Kikuchi | 400/582 |

FOREIGN PATENT DOCUMENTS

| | | | |
|---|---|---|---|
| 0023523 | 3/1978 | Japan | 400/568 |
| 55-114581 | 3/1980 | Japan . | |
| 58-138655 | 8/1983 | Japan . | |
| 59-174377 | 2/1984 | Japan . | |
| 60-235571 | 11/1985 | Japan . | |
| 0236776 | 11/1985 | Japan | 400/582 |
| 0167067 | 7/1987 | Japan | 400/582 |
| 62-216777 | 9/1987 | Japan . | |
| 0294520 | 12/1987 | Japan | 400/568 |
| 0058784 | 3/1988 | Japan | 400/706 |
| 0071375 | 3/1988 | Japan | 400/568 |
| 63-276573 | 11/1988 | Japan . | |
| 1-190478 | 7/1989 | Japan | 400/706 |
| 1-271270 | 10/1989 | Japan | 400/582 |
| 3-216369 | 9/1991 | Japan | 400/582 |

OTHER PUBLICATIONS

IBM Technical Disclosure Bulletin—vol. 22, No. 8A, Jan., 1980 "Self-Correcting Forms Movement System"—E. T. Brown and B. R. Cavill.

*Primary Examiner*—Edgar S. Burr
*Assistant Examiner*—Christopher A. Bennett
*Attorney, Agent, or Firm*—Sughrue, Mion, Zinn, Macpeak & Seas

[57] ABSTRACT

A vertical forms control apparatus for a printer, and a printing method, which corrects dot pitch errors in the subscanning direction. A paper feeding control apparatus is provided with a print head scanned in a direction of paper width and having a plurality (N) of dot forming elements aligned with a dot pitch (P) in a direction in which the paper is advanced, a pulse motor connected to a paper advancing mechanism via a transmission such that the pulse motor requires a plurality of steps to make a rotation corresponding to the dot pitch (P), and a microcomputer for outputting drive pulses to the pulse motor 1, the drive pulses indicating the number-of-steps-for-an-advancement-of-one-line (P×N) plus correction steps. In printing across a plurality of lines with the lines connected together, if blank spaces or overlaps are developed, pulses in a number required for rotating the pulse motor in an amount corresponding to the width of the blank spaces or overlaps are added to or subtracted from a standard value so that the pulse motor undergoes a correct amount of rotation for each line. By this arrangement, errors between lines due to machining errors of parts can be corrected so that image data formed of a plurality of lines can be printed with a high quality with no blank spaces and overlaps.

7 Claims, 7 Drawing Sheets

PAPER FEEDING CONTROL APPARATUS AND METHOD FOR PRINTERS

BACKGROUND OF THE INVENTION

The present invention relates to a paper feeding control apparatus for a serial printer in which a print head has a plurality of dot forming elements aligned in the paper-advancing direction and is scanned in the direction of paper width to print line by line, or a page printer using band memories.

A serial printer prints the entire surface of a sheet of recording paper by forming dots thereon while the print head is scanned in a direction of the paper width in such a way that the paper is advanced by one line each time the print head comes to the end of a line.

This type of printer is designed to print not only characters but also logotypes, enlarged characters, and graphics where a plurality of lines are used to print a single pattern. Thus, the number of steps of a pulse motor as well as the diameters of paper-advancing rollers and gear train ratio are selected so that the paper is accurately advanced a distance equal to $N \times P$, where N is the number of dot forming elements of the print head and P is the pitch of dot forming elements.

However, the paper is not necessarily advanced in the precise manner intended due to dimensional errors of parts and assembly variations of the apparatus. Thus, in printing patterns aligned in the direction in which the paper is advanced, if the actual paper advancement per line is greater than the design value, then a blank A is left, as shown in FIG. 11A. Conversely, if the amount of actual paper advancement is smaller than the design value, then an overlap B is produced, as shown in FIG. 11B. This results in a poor printing quality.

Further, in a printer where a paper ejecting roller is designed to have a peripheral speed a little faster than paper advancement to ensure that the printed recording paper is properly ejected into a ejection tray, the recording paper is pulled by the ejecting roller, as a result of which the paper speed slightly shifts before and after passing this roller. This causes an error in a paper advancement for one line, producing blanks in a printed pattern.

Further, in a wire dot printer or the like, when the printer is used to print on a variety of recording sheets from very thick record media to very thin record media, e.g., when printing many sheets simultaneously, and printing a single sheet of paper, there may exist slight differences in paper advancement as the paper thickness is changed. Particularly, in the case where characters are printed on a ruled continuous paper such as slip paper, the printed characters may deviate from the ruled lines, and the end position of the printing may not be at a perforation of the paper for page section.

Still further, in a page printer using the band memory method where image data for one page is divided into a plurality of sections and stored in a memory, carriage error of a recording-paper advancing mechanism such as a photosensitive drum results in unprinted blanks or overlapped prints between bit map data divided into two adjacent bands.

SUMMARY OF THE INVENTION

The present invention was made in view of the aforementioned drawbacks. A first object of the invention is to provide a paper feeding control apparatus for printers in which the recording paper can be advanced one line distance equal to the print width printed by the print head irrespective of dimensional tolerances of parts and assembly errors of the apparatus.

A second object of the invention is to provide a paper feeding control apparatus for printers in which the recording paper can be advanced one line distance equal to the print width printed by the print head irrespective of the speed of paper ejecting rollers.

A third object of the invention is to provide a paper feeding control apparatus for printers in which the recording paper can be advanced one line distance equal to the print width printed by the print head irrespective of the variations in thickness of paper.

A still further object of the invention is to provide a paper feeding control apparatus for printers in which the jointing errors between memories associated with page printers using band memories can be corrected.

In the present invention, a paper feeding control apparatus, which includes a print head scanned in a direction of width of a sheet of paper and which has a plurality (N) of dot forming elements aligned with a dot pitch (P) in a direction in which sheets of paper are advanced and a paper-advancing mechanism for advancing the paper longitudinally of the paper, is provided with a pulse motor connected to the paper advancing mechanism via a transmission such that the pulse motor requires a plurality of steps to make a rotation corresponding to said dot pitch (P), and a control means for outputting a drive pulse signal to the pulse motor, the drive pulse signal indicating the number of steps for an advancement of one line plus correction steps.

If the printing operation results in blanked or overlapped portions across lines when the printing of a pattern is effected across a plurality of lines, the number of steps of a pulse motor corresponding to the blanked or overlapped portions is subtracted from or added to a specific value S to set a new paper advancement for one line. By this arrangement, the errors between lines due to machining tolerance of parts can be corrected.

DESCRIPTION OF THE PREFERRED EMBODIMENTS

Figure 1:
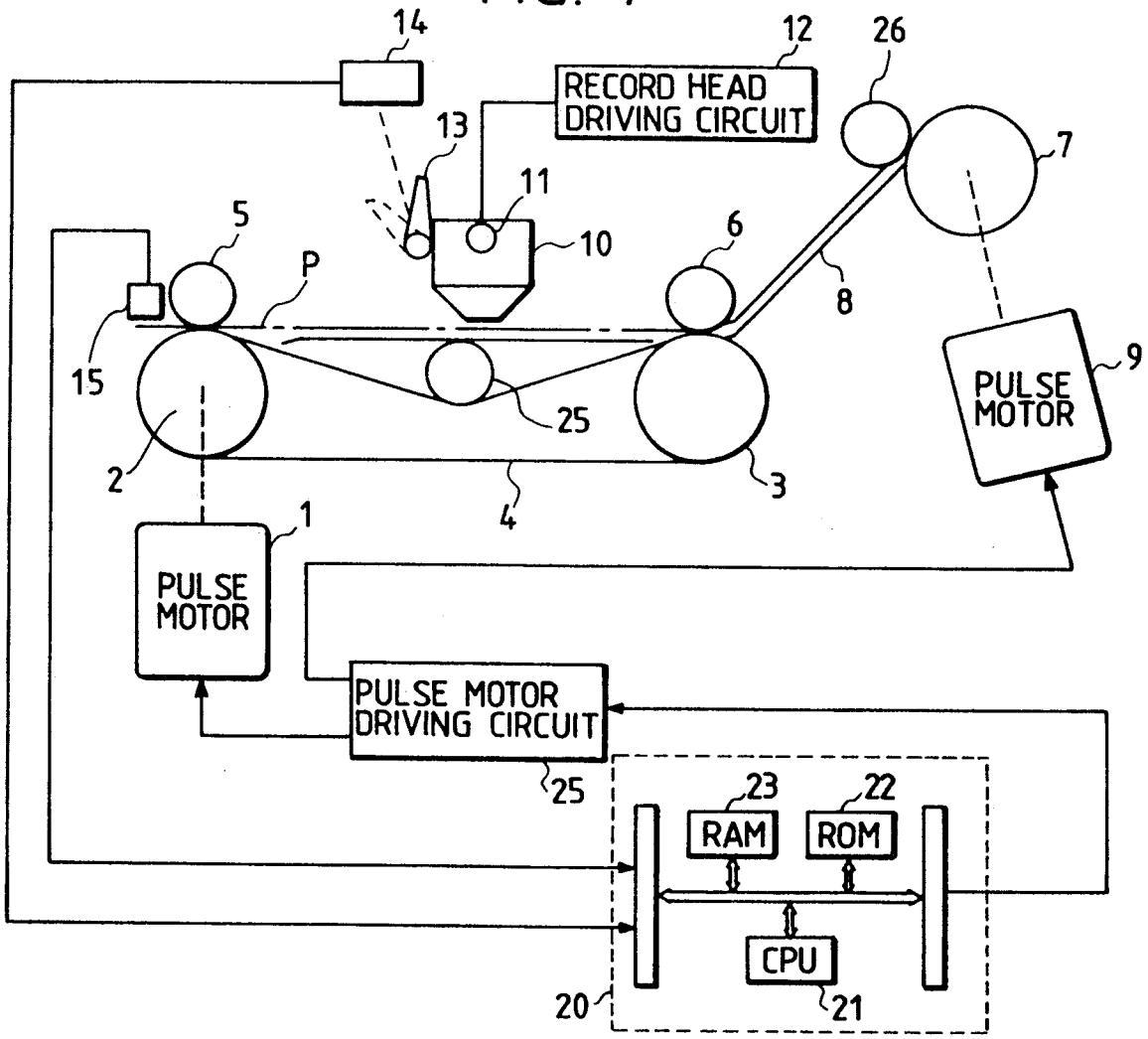
FIG. 1 shows the general construction of a preferred embodiment of a printer controller constructed according to the present invention.
Figure 2:
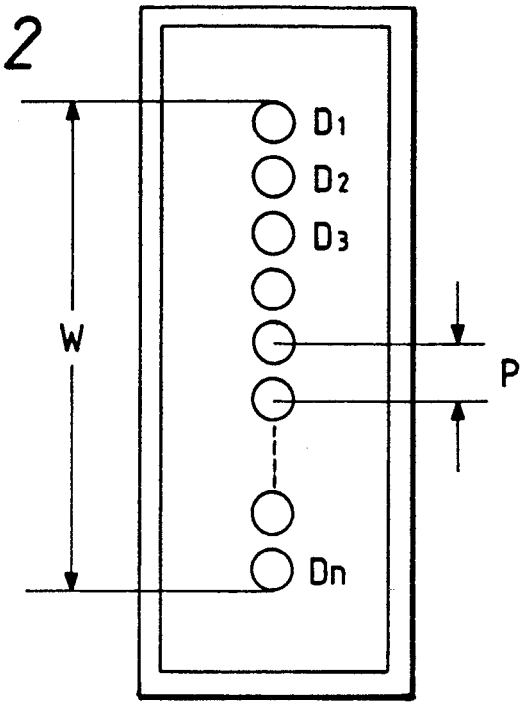
FIG. 2 is a diagram showing an example of dot forming elements.

Preferred embodiments of the present invention will now be described in detail with reference to the drawings. FIG. 1 shows a preferred embodiment of the invention. In the figure, reference numeral 1 is a step motor for driving a paper-advancing mechanism connected to a gate roller 2 that performs registration of the tip end of a recording paper P. A front roller 3 cooperates with the gate roller 2 so as to advance the recording paper at a constant speed. The front roller 3 is connected to the gate roller 2 by a timing belt 4 so that the two rollers rotate at the same peripheral speed. A transmission mechanism, such as a gear train (not shown) which drivingly connects the gate roller 2 to the pulse motor 1, has a selected transmission ratio such that the paper is advanced a distance equal to one dot of dot forming elements of a later-described print head 10 when the pulse motor 1 is driven a predetermined plurality of steps.

The rollers 2 and 3 are in resiliently abutting relation with rollers 5 and 6 that press the paper p against the surface of the rollers 2 and 3. A paper ejecting roller 7 is positioned downstream of the front roller 3 and is normally driven by a step motor 9 at a peripheral speed such that the paper guided by a paper guide 8 is ejected into the tray (not shown), i.e., a peripheral speed about ten percent higher than that of the front roller 3.

The previously mentioned print head 10 is guided by a guide member 11 to move back and forth in the main scanning direction, so that a pattern is dot-printed on the paper p carried between the gate roller 2 and the front roller 3. The recording head 10 prints dots in response to signals from a recording-head driving circuit 12. The head 10 has N dots that form elements D1, D2, . . . Dn aligned in the paper-advancing direction with a pitch W/N, so that the width W of the recording paper can be printed in a single printing operation.

An adjustment lever 13 drives a mechanism that moves the recording head 10 back and forth relative to the printing surface of the recording paper in accordance with the thickness of the paper. The adjustment lever 13 is connected to a lever position detector 14, implemented primarily in the form of switches, which indicates the position selected by the lever 13. A recording paper detector 15, which is positioned near and upstream of the gate roller 2, is in the form of a pair of light emitting elements adapted to detect a change in reflection coefficient due to the presence or absence of the paper. The recording paper detector 15 outputs a signal upon reaching the tip end of the recording paper p to the gate roller 5.

A microcomputer 20 includes a CPU 21, a ROM 22, and a RAM 23, which form altogether a controller. The microcomputer 20 receives signals from the lever position detector 14 and the recording paper detector 15, and is programmed to output a signal to a pulse-motor driving circuit 25 for driving the pulse motors 1 and 9 at predetermined speeds.

Figure 3:
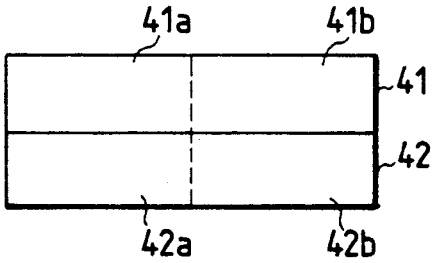
FIG. 3 is an illustrative diagram showing the construction of a number-of-steps-for-one-line-advancement memory.

The ROM 22 has a memory region which implements a number-of-steps-for-one-line memory 34 where sets of data indicative of the number of steps for one line are stored so as to advance in increments of dot pitch W/P for an advancement W exactly equal to one line. The number-of-steps-for-one-line memory 34, as shown in FIG. 3, includes region 41 which stores the data for an original paper mode and a region 42 which stores data of for a copy mode. The respective regions have first data regions 41*a* and 42*a* which store the number of steps for one line advancement for the operation from the initiation of printing until the rear edge of the paper leaves the gate roller 2, and a second regions 41*b* and 42*b* which store the number of steps for one line for the operation after the rear edge of the paper has left the gate roller 2. A roller 25 imposes a tension on the timing belt 4, and a press roller 26 cooperates with the paper ejecting roller 7.

Figure 4:
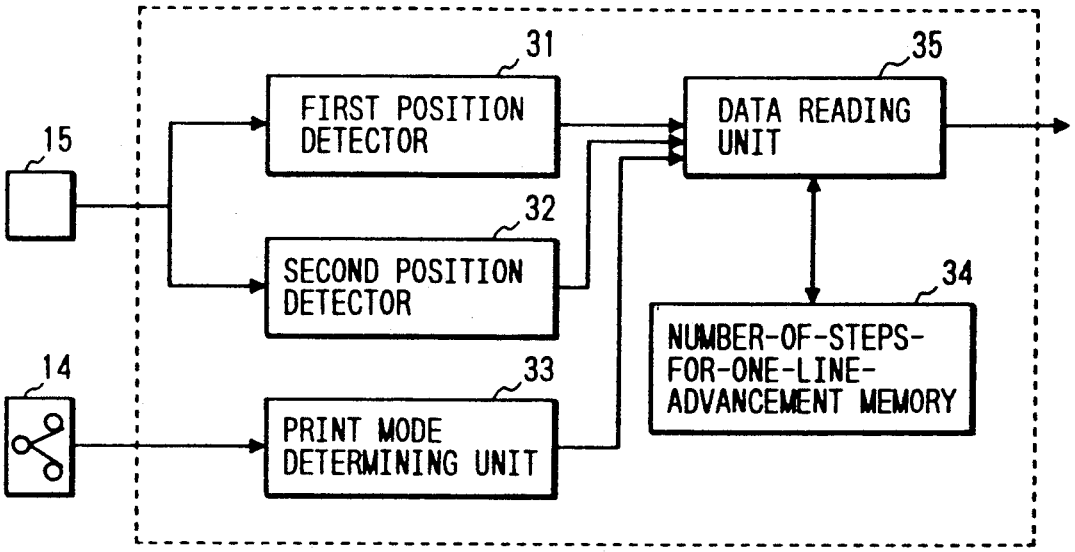
FIG. 4 is a block diagram showing functions to be performed by the microcomputer in the printer controller in FIG. 1.

FIG. 4 is a functional block diagram of the aforementioned microcomputer 20. The microcomputer 20 implements a first position detector 31, a second position detector 32, a printing mode determining unit 33, and the number-of-steps-for-one-line-advancement memory 34, and a data-read-out unit 35. The first position detector 31 detects a print-start timing in terms of a time T1 (equivalent to a number of steps for the pulse motor 1) required from the output of a signal from the paper detector 15 until the front edge of the paper p reaches the printing area. The second position detector 32 detects that the paper p has left the gate roller 2 in terms of a time T2 (equivalent to a number of steps for the pulse motor 1) after the paper detector 15 has outputted a signal and before the rear edge of paper leaves the gate roller 2.

The printing mode determining unit 33 determines whether it is in the ordinary paper mode or in the copy mode on the basis of a signal from the lever position detector 14. The number-of-steps-for-one-line-advancement memory 34 stores the number of steps predetermined in accordance with the position of the paper advancement and the respective printing modes so as to ensure accurate one-line advancement W of the paper. The data-read-out unit 35 reads out the optimum number of steps for one line advancement from the number-of-steps-for-one-line-advancement memory 34 on the basis of the signals from the first position detector 31, the second position detector 32, and the printing mode determining unit 33.

Figure 6A:
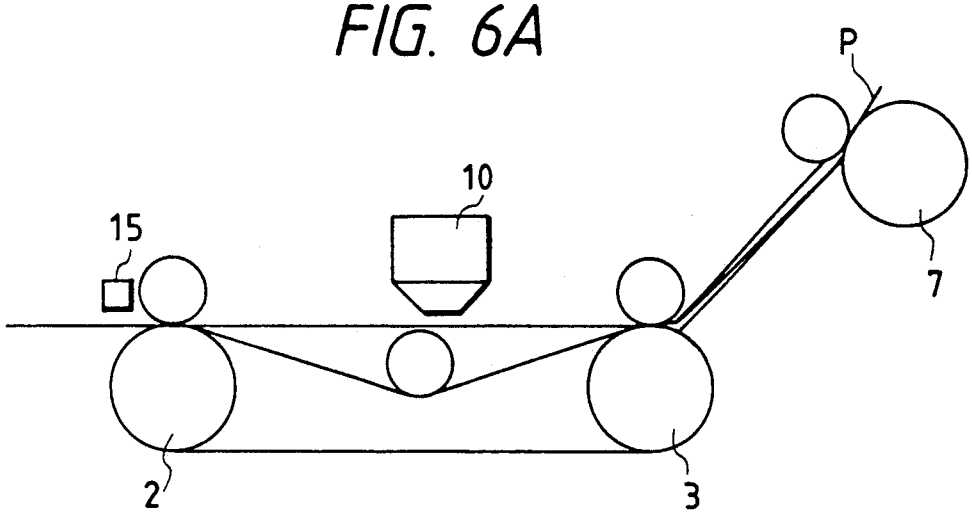
FIGS. 6A and 6B are is an illustrative diagram showing the relationship between the position of recording paper and the respective rollers in the printer controller of FIG. 1.

Upon completion of the assembly of the printer of this embodiment, the number-of-steps-for-one-line-advancement memory 34 is loaded with the numbers of steps $S_{n0}$ and $S_{c0}$ for one-line advancement into the first regions thereof in accordance with the specifications of ordinary paper and copy paper, respectively. Then, an inspection is made for smooth line-to-line connection by performing print operations across at least two consecutive lines through the use of all the dot forming elements D1, . . . Dn of the print head 10 (FIG. 6A) in the print area before the paper leaves the gate roller 2. If no blank space or overlapping is observed in two consecutive lines, the stored data $S_{n0}$ and $S_{c0}$ are loaded, as ultimate numbers-of-steps-for-one-line-advancement for the first print regions of ordinary paper and copy paper, into the first data regions 41*a* and 42*a*, respectively, of the number-of-steps-for-one-line-advancement memory 34.

Likewise, the number-of-steps-for-one-line-advancement memory 34 is loaded with the numbers of steps $S_{n1}$ and $S_{c1}$ for one-line advancement into the second regions thereof in accordance with the specification for ordinary paper and copy paper, respectively.

Figure 6B:
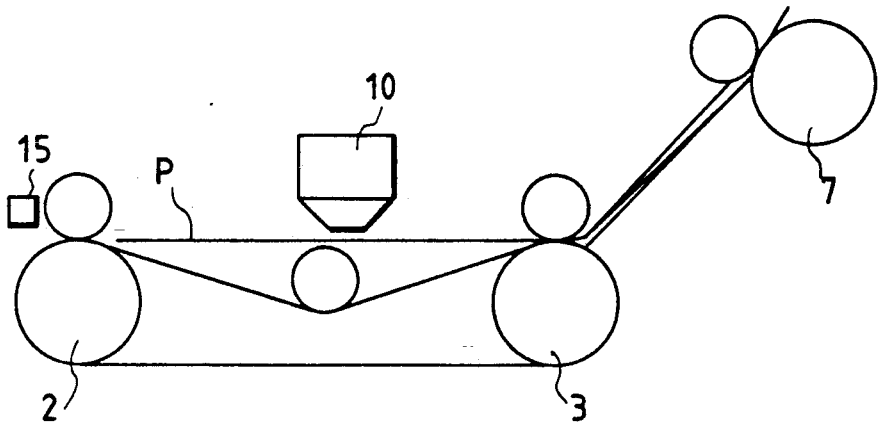

Then, an inspection is made for a smooth line-to-line connection by performing a print operation across at least two consecutive lines in the print area after the paper has left the gate roller 2 through the use of all the dot forming elements D1, . . . Dn of the print head 10 (FIG. 6B). If no blank space or overlapping results between the two consecutive lines, the stored data $S_{n1}$ and $S_{c1}$ are loaded, as the ultimate numbers of steps for one line advancement of the second print regions for ordinary paper and copy paper, into the second data regions 41*b* and 42*b*, respectively, of the number-of-steps-for-one-line-advancement memory 34.

Figure 5:
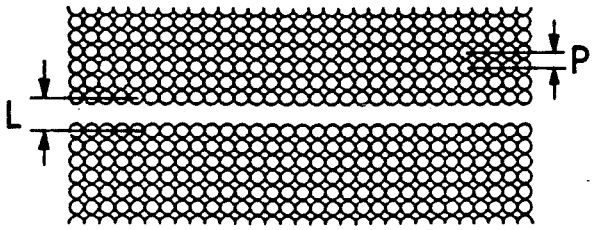
FIG. 5 is an illustrative diagram showing the relationship between the parameters of errors developed in paper advancement and dot pitch.

On the other hand, if an overlap of dots or a blank space is observed across two adjacent lines, the space or the overlap (minus polarity) ΔLn for ordinary paper and ΔLc for copy paper between the two lines, as indicated in FIG. 5, is measured, and the following values $S_{n2}$ and $S_{n2}$ are stored as first numbers of steps for one line for ordinary paper and for copy paper into the first data regions 41*a* and 42*a*, respectively, of the number-of-steps-for-one-line-advancement memory 34:

$$S_{n2}=S_{n0}-INT\,[\{(\Delta Ln)/(P/M)\}+0.5]$$

$$S_{c2}=S_{c0}-INT\,[\{(\Delta Lc)/(P/M)\}+0.5]$$

where INT indicates that an integer value is to be taken, $S_{n0}$ and $S_{c0}$ are the numbers of steps for one line advancement specified in design specifications, P is a dot pitch, P/M is a minimum advancement of paper or the resolution of paper advancement, and (ΔLn) is the absolute value of an error in paper advancement. (ΔLn)/(P/M) indicates an advancement to be corrected in terms of the number of drive pulses for the pulse motor 1.

For example, for a large solid image required to be printed with two lines where the second printing is performed after the rear edge of the paper has left the gate roller 2, it is easy to determine whether or not adjacent lines of printing are correctly aligned and connected, printed on a sheet of recording paper. In other words, when the recording paper p is advanced under sufficient drag imposed by the gate roller 2 and front roller 3, the recording paper may be advanced at a speed corresponding to the rate of rotation of the front roller 3 while the paper is pulled by the paper ejecting roller 7. However, when the rear edge of paper has left the gate roller 2 but is still held by the paper ejecting roller 7, only the front roller 3 imposes a drag on the paper against the tensile force of the paper ejecting roller 7. Thus, the smaller drag on the paper may well allow the paper ejecting roller 7 to pull the paper faster. If a blank space occurs between the two adjacent lines on both ordinary paper and copy paper, then the following values $S_{n3}$ and $S_{c3}$ are stored as the numbers of steps for one line advancement of the second region for ordinary paper and copy paper, respectively, into the second data regions 41*b* and 42*b* of the number-of-steps-for-one-line advancement memory 34:

$$S_{n3}=S_{n1}-INT\,[\{(\Delta Ln)/(P/M)\}+0.5]$$

$$S_{c3}=S_{c1}-INT\,[\{(\Delta Lc)/(P/M)\}+0.5]$$

Figure 7:
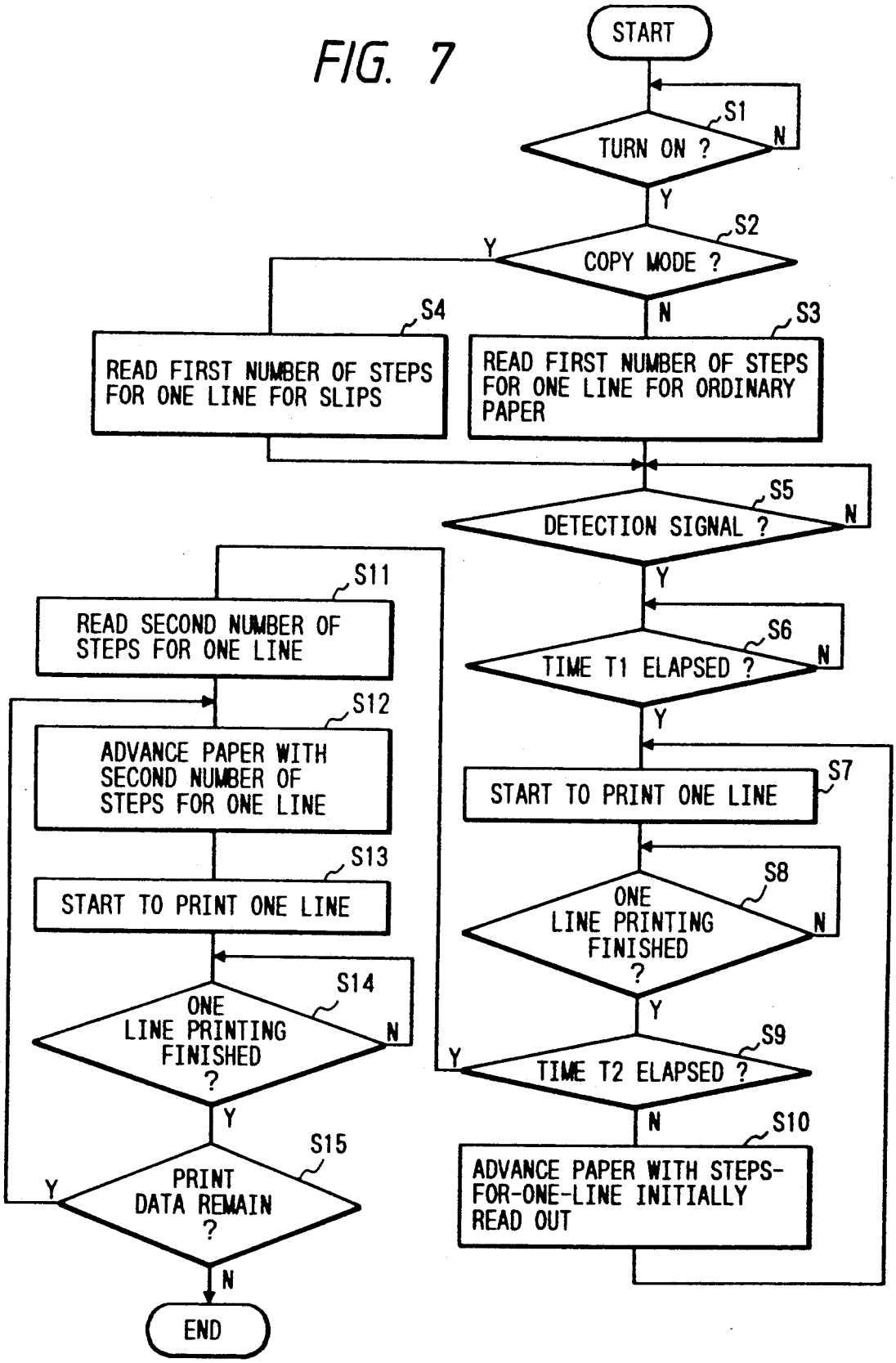
FIG. 7 is a flowchart showing the operation of the printer controller of FIG. 1.

The operation of the thus-constructed apparatus will be described with reference to the flowchart shown in FIG. 7.

When the apparatus is turned on (step S1), the microcomputer 20 determines whether it is in the mode for printing ordinary paper or in the mode for printing thick paper (such as copy paper or envelopes) on the basis of the signal from a switch 14 which drivingly operates with the adjustment lever 13, i.e., the so-called copy mode (step S2). The ordinary paper is assumed in this case, and thus the number of steps for one line advancement $S_{n1}$ is read out of the number-of-steps-for-one-line-advancement memory 34 and is set as the number of steps for one line advancement (step S3).

The microcomputer 20 drives the pulse motor 1 such that the recording paper is advanced line by line in accordance with the currently set number $S_{n1}$ of steps for one line advancement. The microcomputer also drives the pulse motor 9 at a speed about ten percent higher than the peripheral speed of the gate roller 2 and the front roller 3. When the recording paper is delivered to the paper detector 15 in accordance with the number $S_{n1}$ of steps for one line advancement, the paper detector outputs a signal (step S5). After elapse of a predetermined time T1 or after the pulse motor has rotated through a predetermined number of steps (step S6), when an area of recording paper p available for printing reaches the recording head 10 so that the front end of a print area of recording paper assigned by the selected print format faces the recording head 10, the recording-head driving circuit 12 receives a signal from a host apparatus (not shown) and outputs a drive signal to the recording head 10 in accordance with the data to be printed, so that the drive signal causes the dot forming elements D1 . . . Dn to start the printing of one line (step S7).

When printing is completed for one line (step S8), on the basis of the data $S_{n1}$ from the number-of-steps-for-one-line-advancement memory 34, the microcomputer 20 calculates the number of steps that is equivalent to the line pitch specified by print format so as to drive the pulse motor 1 based on the thus-calculated number of steps to advance the paper (step S10).

In this manner, the print operation of a sheet of recording paper is carried out.

A time T2 after the recording paper has passed the paper detector 15 (or after the pulse motor 1 has rotated a predetermined number of steps) (step S9), the paper p enters the paper ejecting roller 7. Thus, a tensile force is imposed on the paper p, but the amount of advancement remains the same since the paper is held by both the gate roller 2 and the front roller 3. When the rear edge of the recording paper p has passed the gate roller 2, the paper is held only by the front roller 3 and the paper is unable to sufficiently resist the tensile force of the paper ejecting roller 7, with the result that the paper advancement slightly increases due to slippage of the paper.

After the time T2 has been elapsed after the paper detector 15 has outputted a paper detection signal, i.e., when the rear edge of paper p has passed the gate roller 2, the microcomputer 20 reads the second data $S_{n3}$ from the first region in the number-of-steps-for-one-line-advancement memory 34 so as to control the rotating steps of the pulse motor 1 in accordance with the data $S_{n3}$. As a result, the paper is advanced an amount equal to the width W as the amount of advancement for one line irrespective of the tension imposed by the paper ejecting roller 7. As a result, graphic data, where the entire surface of recording paper is regarded as a single region to be printed, can be printed without lines or blank portions. Also, in printing the data in alignment with ruled positions on ruled continuous paper, characters can be printed with a predetermined space between the ruled lines.

In printing on a recording medium such as slips where a plurality of sheets of recording paper are stacked, or when printing on a thick recording medium such as envelopes, the gap between the surface of paper and dot forming elements D1 . . . Dn changes by the total thickness of the recording paper. In order to set this distance as a predetermined distance, the adjustment lever 13 is set to the copy mode position so that the recording head is retracted relative to the paper to set the gap distance to the predetermined distance.

Operating the adjustment lever 13 causes the lever position detector 14 connected thereto to output a signal indicative of the thickness of the stacked paper. The microcomputer 20 detects with a signal from the lever position detector 14 that the apparatus has been set to the copy mode (step S2) to access the second region 42 of the number-of-steps-for-one-line-advancement memory 34.

The microcomputer 20 reads the number-of-steps-for-one-line-advancement for the first print region from the number-of-steps-for-one-line-advancement memory 34 (step S4).

Then, the microcomputer 20 drives the pulse motor 1 on the basis of the number-of-steps-for-one-line-advancement so that the pulse motor 1 is driven at a peripheral speed that cancels out an increase in paper advancement speed caused due to the thickness of the paper. When the paper reaches the paper detector 15, the paper detector 15 outputs a signal (step S5).

When the area of recording paper p available for printing has reached the recording head 10 after a predetermined time T1 (or after the pulse motor has rotated a predetermined amount) so that the tip end of formatted print area of the recording paper faces the recording head 10, the recording head driving circuit 12, after receiving a signal from a host apparatus (not shown), outputs a drive signal to the recording head 10 for initiation of the printing of one line.

When the printing of one line is completed (step S8), the microcomputer 20 calculates the number of steps coincident with a formatted line-to-line pitch on the basis of the data $S_{c2}$ from the number-of-steps-for-one line-advancement memory 34. The pulse motor is driven with this number of steps for paper advancement (step S10).

In this manner, a sheet of recording paper p is printed and then enters the paper ejecting roller 7. A tensile force is imposed on the recording paper p by the paper ejecting roller 7. At this stage, the paper is held in a sandwiched relation by the gate roller 2 and the front roller 3 so that the paper is advanced with an accurate amount of advancement. Then, the printing operation further proceeds until the rear edge of the recording paper has passed the gate roller 2, so that the paper is held only by the front roller 2. Thus, since the paper cannot quite resist the tensile force imposed by the paper ejecting roller 7, the amount of paper advancement increases due primarily to slippage.

After the time T2 has elapsed after the paper detector 15 has outputted a paper detection signal, i.e., when the rear edge of the recording paper has passed the gate roller 2, the microcomputer 20 reads the second data $S_{c3}$ in the second region of the number-of-steps-for-one-line-advancement memory 34 to control the number of rotational steps of the pulse motor 1 on the basis of the data $S_{c3}$. Thus, the paper is advanced by an amount equal to the width W of the recording head 10 as a one-line-advancement.

Consequently, printing is performed without missing dots between lines irrespective of the change in thickness of the recording paper. Therefore, a graphic data image where the entire surface of the paper is regarded as a single region to be printed can be printed without resulting in lines or line-like blank portions in the printed pattern. Also, in printing data in alignment with ruled positions of ruled continuous paper, characters can be printed with a predetermined space between the ruled lines.

If a change in the amount of paper advancement occurs due to wear and tear of parts due to prolonged use of the apparatus, the width of the space at the boundary of adjacent lines or the overlap width $\Delta L$ is measured in the same manner as an initial measurement shortly after assembly of the apparatus so as to store a new number-of-steps-for-one-line-advancement into the number-of-steps-for-one-line-advancement memory 34, thereby regaining the initial performance. Of course, in a printing operation where a space is intentionally provided between lines, e.g., when printing characters, pulses corresponding to that space are added to the number-of-steps-for-one-line-advancement for proper paper advancement.

In the case where a pulse motor requiring 400 pulses per one revolution is used to drive a platen having a peripheral length of 8/3 inches through a transmission mechanism having a gear reduction ratio of $\frac{1}{8}$, and where a print head has 64 dot forming elements with a dot pitch $W/N=P=1/300$ inches, if the print head is driven with 256 pulses for one line printing, that is, four pulses per one dot pitch, adverse effects, such as spaces and overlaps in printing, will not occur.

If spaces and overlaps do develop between lines, a dot pitch P and a distance $\Delta L$ or an overlap $-\Delta L$ between the final dot of the preceding line and the to dot of the following line are measured to calculate the value shown below and to store it as a number-of-steps-for-one-line-advancement.

$$256-\mathrm{INT}\,[(\Delta L)/(P/4)+0.5]$$

It was observed that spaces and overlaps developed when advancing the recording paper on a line-by-line basis can be corrected in increments of $\frac{1}{4}$ dot pitch, that is, 1/1200 inch.

Figure 8:
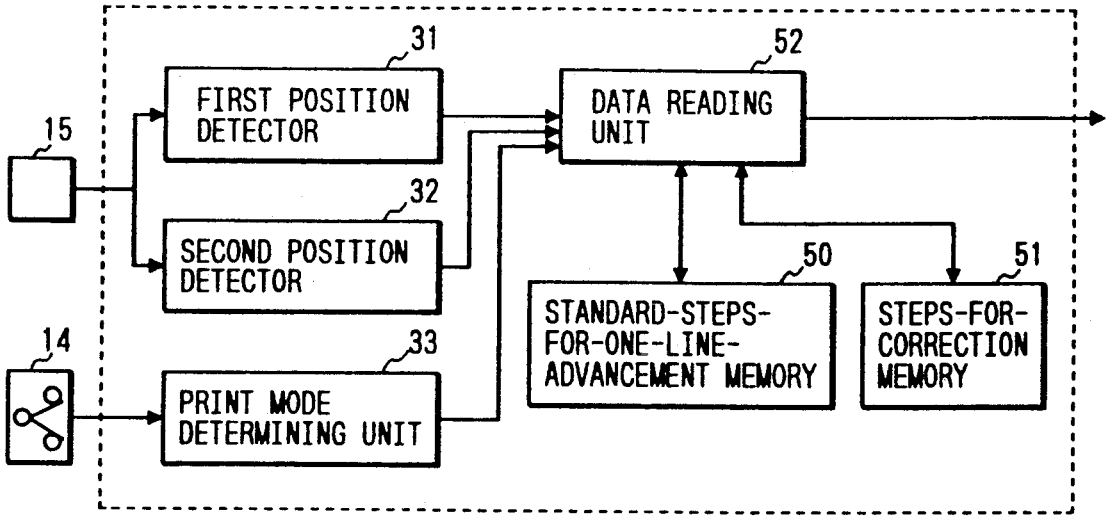
FIG. 8 is a block diagram showing a second embodiment of the invention in terms of functions to be performed by the microcomputer.

This embodiment has been described with respect to the number of steps sufficient for one-line advancement of paper stored in the number-of-steps-for-one-line-advancement memory 34. The same result can be obtained as follows:

As shown in FIG. 8, a standard-number-of-steps-for-one-line-advancement memory 50 stores the number of steps for one line specified by design specification, and a number-of-steps-for-correction memory stores the number-of-steps-for-correction $(\Delta Ln)/(P/M)$ found from testing. Then, the data reading unit 52 determines the difference between the two memories and the sum of both so as to advance the paper based on these data.

Figure 9:
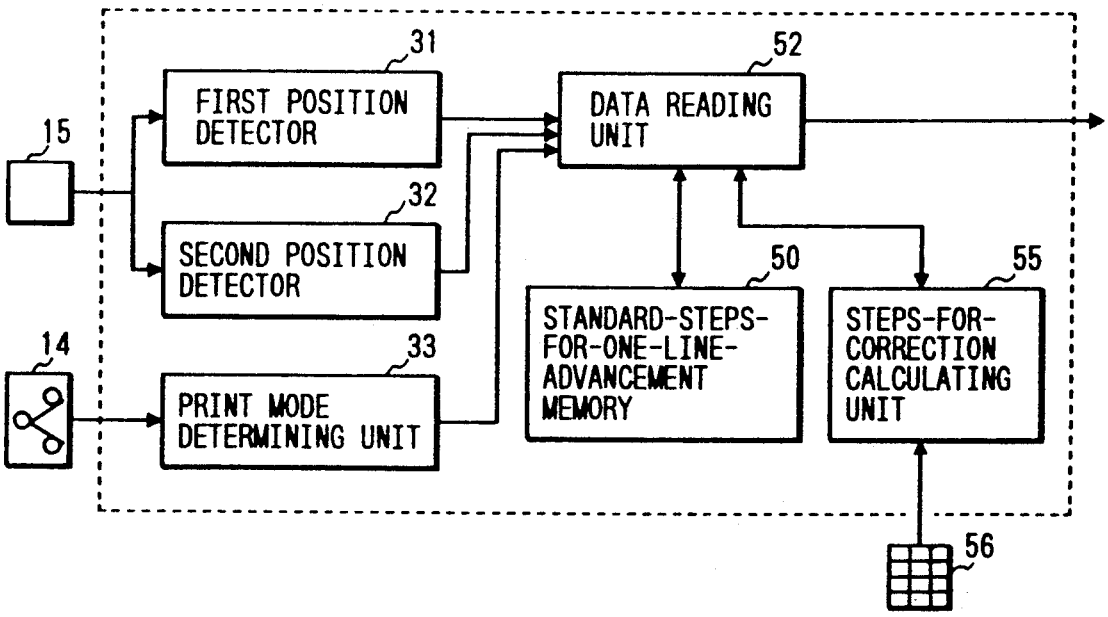
FIG. 9 is a block diagram showing a third embodiment of the invention in terms of functions to be performed by the microcomputer.

The same result may also be obtained as follows:

As shown in FIG. 9, a keyboard 56 is provided for inputting a width ΔL of spaces and overlaps obtained through examination, and a number-of-steps-for-correction calculating means 55 is provided for calculating the correction on the basis of the data ΔLn, so that the steps for correction (ΔLn)/(P/M) can be calculated.

Although the above embodiment has been described with respect to an example where the recording paper is advanced by the gate roller 2 and the front roller 3, the same result may also be obtained by the use of a platen for advancing the recording paper.

While the above embodiment has been described with respect to an example where the recording paper is advanced by the platen, the similar operation may be obtained by applying the invention to an apparatus where the paper is advanced by paper advancing rollers provided in addition to the platen.

Further, although the paper ejecting roller 7 is driven by a separate motor in the above embodiment, the same operation may be obtained by connecting the paper ejecting roller 7 to the paper advancing mechanism via a speed-increasing mechanism.

Figure 10A:
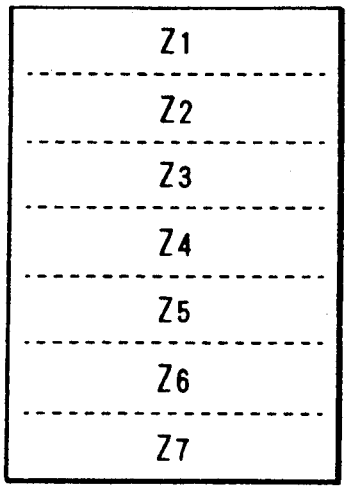
FIGS. 10A and 10B are illustrative diagrams showing a photosensitive-body driving mechanism of a page printer using a band memory to which the present invention is applied.
Figure 10B:
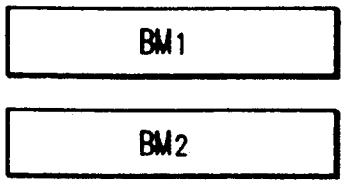
Figure 11A:
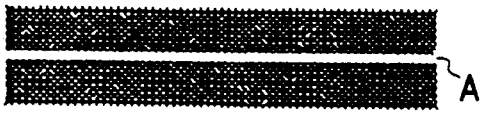
FIGS. 11A and 11B are illustrative diagrams showing a belt-like space and an overlap resulting during a continuous printing operation due to errors in paper advancement.
Figure 11B:
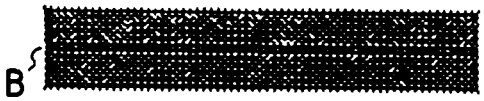

Moreover, while the above preferred embodiment has been described with respect to a serial dot printer, the same operation may be implemented by applying the invention to a page printer where data Z1 to Z7 in an image memory for one page as shown in FIG. 10A appears several times in a plurality of small capacity memories or so-called band memories BM1 and BM2 as shown in FIG. 10B. In other words, in laser printers, the recording paper is advanced in synchronism with the rotation of a photosensitive drum. Thus, the present invention may be applied to the control of the number of drive steps for a photosensitive-drum driving step motor such that the photosensitive drum rotates in accordance with the resolution of data from upper and lower ends of the respective band memories BM1 and BM2.

As described above, a control apparatus according to the present invention is provided with a print head having a plurality of dot forming elements (N) aligned with a dot pitch (P) in a direction in which a sheet of paper is advanced, a paper-advancing mechanism driven by a pulse motor via a transmission such that the motor requires a plurality of steps for a dot pitch P, and a control device for outputting drive pulses for one line advancement, namely, the sum of steps S (advancement P for one line times N) and steps for correction. Thus, spaces and overlaps developed between lines when a solid image is printed can be corrected by correcting the increments of steps for advancing the recording paper. This allows adjustment of an amount of one line advancement with a high degree of freedom and without a cost increase. Thus, the invention is advantageous in printing data across a plurality of lines, and it yields a high quality image.

Additionally, because the amount of paper advancement can be adjusted without difficulty by increasing or decreasing the number of steps, the invention is advantageous in that printing papers of different thickness can be used. Also, the stored data can be easily updated, even if relative errors develop between the printed data and the stored data due to wear of the apparatus over time, so that the recording paper can be accurately advanced with a pitch equal to that of the print data.

What is claimed is:

1. A printing apparatus comprising:

a print head and means for scanning said print head in a direction of width of a paper to be printed, said print head having a plurality (N) of dot forming elements aligned in a longitudinal direction of said paper and with a dot pitch (P) in the longitudinal direction;

a paper-advancing mechanism for advancing said paper in the longitudinal direction;

a pulse motor and a transmission, said pulse motor being connected to said paper advancing mechanism via said transmission such that said pulse motor requires a plurality of steps to make said pulse motor rotate an amount corresponding to an advancement of said paper advancing mechanism in the longitudinal direction equal to said dot pitch (P); and control means for outputting drive pulses to said pulse motor to advance said paper in a number of steps (S) for an advancement of said paper by one line (P×N) plus a number of steps for correction wherein said pulse motor is advanced by a fraction of said dot pitch.

2. The printing apparatus according to claim 1, further comprising:

a plurality of sets of number-of-steps-for-one-line-advancement data;

means for storing said data; and means for determining a thickness of said paper, wherein said number-of-steps-for-one-line-advancement data is determined in accordance with the thickness of said paper.

3. The printing apparatus according to claim 1, further comprising:

a plurality of sets of number-of-steps-for-one-line-advancement data;

means for storing said data; and means for determining a position of said paper, wherein said number-of-steps-for-one-line-advancement data is determined in accordance with the position of said paper.

4. The printing apparatus according to claim 1, further comprising:

a plurality of sets of number-of-steps-for-one-line-advancement data for eliminating blank spaces, overlapping and misalignment between adjacent printing lines printed by said print head; and means for storing said data.

5. A printing method comprising the steps of:

scanning a print head having a plurality of dot forming elements arranged with a predetermined dot pitch as measured in a paper advancing direction over the surface of a recording sheet in a print head scanning direction;

driving said print head with a recording signal to cause said printing head to print dots on said recording sheet in a line in a pattern determined by said recording signal;

advancing said recording sheet in the paper advancing direction by applying pulses to a pulse motor driving a paper-advancing mechanism;

determining a number of pulses applied to said pulse motor in accordance with both a predetermined line spacing between adjacent lines to be printed by said print head and a correction amount corresponding to a fraction of the dot pitch so as to eliminate blank spaces, overlapping and misalignment between adjacent lines printed by said print head.

6. The printing method of claim 5, further comprising the steps of determining a thickness of said recording sheeting, and determining said correction amount in accordance with said thickness.

7. The printing method of claim 5, further comprising the steps of determining a position of said paper, and determining said correction amount in accordance with said position.

* * * * *